US005931239A

United States Patent [19]

Schuh

[11] Patent Number: 5,931,239

[45] Date of Patent: Aug. 3, 1999

[54] ADJUSTABLE STABILIZER FOR DIRECTIONAL DRILLING

[75] Inventor: Frank J. Schuh, Plano, Tex.

[73] Assignee: TeleJet Technologies, Inc., Dallas, Tex.

[21] Appl. No.: 08/968,176

[22] Filed: Nov. 12, 1997

Related U.S. Application Data

[63] Continuation-in-part of application No. 08/882,798, Jun. 26, 1997, which is a continuation of application No. 08/757,139, Dec. 3, 1996, abandoned, which is a continuation of application No. 08/446,006, May 19, 1995, abandoned.

[51] Int. Cl.[6] ..... E21B 7/04

[52] U.S. Cl. ..... 175/61; 175/76; 175/107; 175/325.3

[58] Field of Search ..... 175/61, 73, 74, 175/76, 107, 325.1–325.3

[56] References Cited

U.S. PATENT DOCUMENTS

| | | | |
|---|---|---|---|
| 3,092,188 | 6/1963 | Farris et al. | 175/76 |
| 3,545,825 | 12/1970 | Hamilton | 308/6 |
| 3,593,810 | 7/1971 | Fields | 175/61 |
| 3,595,326 | 7/1971 | Claycomb | 175/73 |
| 4,105,262 | 8/1978 | Richey | 308/4 A |
| 4,131,167 | 12/1978 | Richey | 175/323 |
| 4,270,618 | 6/1981 | Owens | 175/57 |
| 4,394,881 | 7/1983 | Shirley | 175/76 |
| 4,600,063 | 7/1986 | Beasley | 175/325 |
| 4,635,736 | 1/1987 | Shirley | 175/76 |
| 4,638,873 | 1/1987 | Welborn | 175/73 |
| 4,754,821 | 7/1988 | Swietlik | 175/325 |
| 4,947,944 | 8/1990 | Coltman et al. | 175/73 |
| 4,951,760 | 8/1990 | Cendre et al. | 175/269 |
| 5,038,872 | 8/1991 | Shirley | 175/76 |
| 5,050,692 | 9/1991 | Beimgraben | 175/61 |
| 5,070,950 | 12/1991 | Cendre et al. | 175/74 |
| 5,074,366 | 12/1991 | Karlsson et al. | 175/76 |
| 5,094,304 | 3/1992 | Briggs | 175/76 X |
| 5,139,094 | 8/1992 | Prevedel et al. | 175/61 |
| 5,180,021 | 1/1993 | Champion et al. | 175/76 |
| 5,181,576 | 1/1993 | Askew et al. | 175/61 |
| 5,186,264 | 2/1993 | du Chaffaut | 175/76 X |
| 5,265,684 | 11/1993 | Rosenhauch | 175/61 |
| 5,293,945 | 3/1994 | Rosenhauch et al. | 175/325.2 |
| 5,311,953 | 5/1994 | Walker | 175/61 |
| 5,318,137 | 6/1994 | Johnson et al. | 175/40 |
| 5,318,138 | 6/1994 | Dewey et al. | 175/74 |
| 5,332,048 | 7/1994 | Underwood et al. | 175/26 |
| 5,810,100 | 9/1998 | Stamford | 175/325.3 |

FOREIGN PATENT DOCUMENTS

| | | | |
|---|---|---|---|
| 3534662 A1 | of 0000 | Germany | E21B 7/20 |
| WO 93/12319 | 6/1993 | WIPO | E21B 7/04 |
| WO 93/18273 | 6/1993 | WIPO | E21B 7/06 |

OTHER PUBLICATIONS

Warren, T.M., et al. "Short–Radius Lateral Drilling System," SPE 24611, pp. 693–705, 1992.

Chur, C., and Oppelt, J., "Vertical Drilling Technology: A Milestone in Directional Drilling," SPE/IADC 25759, pp. 789–801, 1993.

Underwood, L.D., and Odell II, A.C., "A Systems Approach to Downhold Adjustable Stabilizer Design and Application," IADC/SPE 27484, pp. 475–488, 1994.

Barr, J.D. et al., "Steerable Rotary Drilling With an Experimental System," SPE/IADC 29382, pp. 435–450, 1995.

*Primary Examiner*—Roger Schoeppel

*Attorney, Agent, or Firm*—Felsman, Bradley, Gunter & Dillon, LLP

[57] ABSTRACT

A drillstring carries a stabilizer sub above the drill bit for steering or directing drilling. The stabilizer body is rotatably carried by the stabilizer sub, wherein the stabilizer body remains substantially stationary relative to the borehole as the drillstring rotates. At least one stabilizer blade is carried by the stabilizer body, the stabilizer blade being radially extendable from the stabilizer body and into engagement with the sidewall of the borehole. Each stabilizer blade is extendable and retractable from the stabilizer body independently of the others. The stabilizer blades are coupled to the stabilizer body such that the blades are capable of collapse to minimum radial extension if the stabilizer assembly becomes stuck in the borehole.

22 Claims, 3 Drawing Sheets

ADJUSTABLE STABILIZER FOR DIRECTIONAL DRILLING

CROSS REFERENCE TO RELATED APPLICATIONS

This application is a continuation-in-part of application Ser. No. 08/882,798, filed Jun. 26, 1997, which is a continuation of application Ser. No. 08/757,139, filed Dec. 3, 1996, now abandoned, which is a continuation of application Ser. No. 08/446,006, filed May 19, 1995 now abandoned.

BACKGROUND OF THE INVENTION

1. Field of the Invention

The present invention relates generally to apparatus for use in drilling directional boreholes. More specifically, the present invention is related to stabilizer assemblies carried by a drillstring for altering the direction of drilling from vertical.

2. Background Information

The earliest efforts to drill directionally for petroleum hydrocarbons employed mechanical whipstocks, which were used to deflect a rotating drillstring from vertical in a previously vertical wellbore. The chief drawback to the use of whipstocks is that directional control of the bit and drillstring is lost once the drillstring is kicked off or deflected by the whipstock. Additionally, whipstock operations are time-consuming and therefore expensive.

Another method of directional drilling uses a bent or bendable sub with a downhole motor or turbine. The bent sub has a bend formed therein to position the drill bit a few degrees from the vertical axis of the remainder of the drillstring. A downhole motor is coupled between the bent sub and drill bit or is incorporated in the bent sub itself. The drillstring and downhole motor may be rotated to cause the bit to disintegrate formation and drill straight ahead at the same angle and azimuth of the existing borehole. When altering the direction of drilling is desirable, rotation of the drillstring is stopped and the bit is rotated by the drilling motor. This mode of operation is known as the "sliding" mode, because the drillstring is sliding rather than rotating with respect to the sidewall of the borehole. In the deviated portion of the borehole, the drillstring experiences sufficient frictional contact with the sidewall of the borehole to make it difficult to apply significant weight to the bit, resulting in reduced rates of penetration compared with rotary drilling. Examples of bent sub or motor directional drilling systems and method are disclosed in U.S. Pat. No. 5,311,953, May 17, 1994 to Walker; U.S. Pat. No. 5,139,094, Aug. 18, 1992 to Prevedel et al; and U.S. Pat. No. 5,050,692, Sep. 24, 1991 to Beimgraben.

In another directional drilling system and method, a pair of stabilizers is provided in the drillstring and are spaced-apart above the drill bit. The difference in diameter between the upper stabilizer and the near-bit stabilizer, whether adjustable or fixed, and the spacing between the stabilizers, provide lateral forces that assist in deflecting the bit from the vertical axis of the borehole. Such stabilizer arrangements are employed in both rotary drilling and downhole motor arrangements. If the stabilizers are adjustable and employed in surface rotation drilling, each stabilizer blade must extend from the stabilizer body the same distance to maintain symmetry and avoid eccentricity and associated rough running. If drilling is accomplished with a drilling motor, no such limitation is imposed on the upper stabilizer, above the drilling motor, because it is not rotated. Examples of stabilizer arrangements are found in U.S. Pat. No. 5,332,048, Jul. 26, 1994 to Underwood et al; U.S. Pat. No. 5,293,945, Mar. 15, 1994, to Rosenhauch et al.; U.S. Pat. No. 5,181,576, Jan. 26, 1993 to Askew et al.; and U.S. Pat. No. 4,754,821, Jul. 1, 1988 to Swietlik.

A variation on the adjustable stabilizer theme is to provide stabilizer bodies having fixed stabilizer blades, but having pistons acting between the drillstring or stabilizer sub and the fixed stabilizer bodies to introduce eccentricities between the upper and lower stabilizers and resulting lateral deflection forces. These arrangements require multiple piston actuations per revolution of the drillstring and thus present mechanical and reliability disadvantages. Examples of such arrangements can be found in U.S. Pat. No. 5,038,872, Aug. 13, 1991 to Shirley and U.S. Pat. No. 3,593,810, Jul. 20, 1971 to Fields.

U.S. Pat. No. 4,947,944, Aug. 14, 1990 to Coltman et al. discloses a stabilizer that employs electric motors to actuate stabilizer blades independently in a stabilizer sub that rotates independently of the drillstring to which it is coupled. This permits the stabilizer blades to remain stationary relative to the borehole and simplifies the process significantly. One drawback to the Coltman device is that is does not appear to be collapsible in a "fail-safe" state to a reduced radial dimension in the event the stabilizer becomes stuck in the borehole due to malfunction.

A needs exists, therefore, for a directional drilling assembly or system for use with an efficient rotating drillstring that permits the driller to control precisely the trajectory of the bit during drilling operation and that is capable of being withdrawn from the borehole relatively easily in the event of malfunction.

SUMMARY OF THE INVENTION

It is a general object of the present invention to provide an improved assembly for steering a rotating drillstring in a borehole.

This and other objects of the present invention are accomplished by providing a stabilizer sub for attachment into a drillstring proximal to a drill bit. A stabilizer body is rotatably carried by the stabilizer sub, wherein the stabilizer body remains substantially stationary relative to the borehole as the drillstring rotates. At least one stabilizer blade is carried by the stabilizer body, the stabilizer blade being radially extendable from the stabilizer body and into engagement with the sidewall of the borehole. Each stabilizer blade is coupled to the stabilizer body or sub in such a manner that the blades can be collapsed to a reduced radial dimension upon malfunction or failure of the stabilizer or in the event it becomes stuck in the borehole.

According to the preferred embodiment of the present invention, at least three stabilizer blades are spaced apart on the circumference of the stabilizer body. Each stabilizer blade is selectively extendable and retractable independently of the others.

According to the preferred embodiment of the present invention, each stabilizer blade is carried in a longitudinal slot in the stabilizer body, the slot having an inclined bottom such that relative longitudinal movement between the stabilizer blade and stabilizer body causes extension or retraction of the stabilizer blade. A motor is coupled between each stabilizer blade and the stabilizer body to cause relative longitudinal movement there between.

According to the preferred embodiment of the present invention, the stabilizer sub includes a fixed stabilizer at an end opposite the drill bit. A lead screw couples the motor to the stabilizer blade, wherein rotation of the lead screw by the motor cause the relative longitudinal movement.

DESCRIPTION OF THE PREFERRED EMBODIMENT

Figure 1:
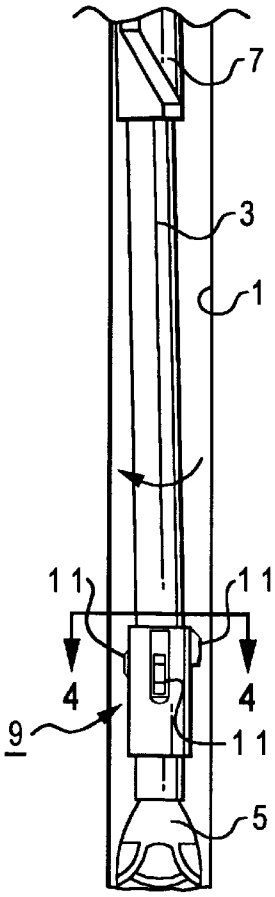
FIG. 1 is a longitudinal section view of a borehole illustrating the steering assembly according to the present invention.

Referring now to the Figures, and specifically to FIG. 1, a longitudinal section view of a borehole 1 having a steering assembly disposed therein is depicted. Steering assembly includes a stabilizer sub 3, which is conventionally connected by a threaded tool joint into a conventional rotary drillstring (not shown). A drill bit 5, of either the fixed or rolling cutter variety, is secured to the lowermost end of stabilizer sub 3. A fixed stabilizer 7 is carried by stabilizer sub 3 and spaced apart from bit 5. An adjustable stabilizer 9, including a plurality of stabilizer blades 11, is carried by stabilizer sub 3 at its lower end, near drill bit 5. Alternatively, upper stabilizer 7 can be an adjustable stabilizer, as well, further increasing the versatility of the steering assembly according to the present invention.

Figure 2:
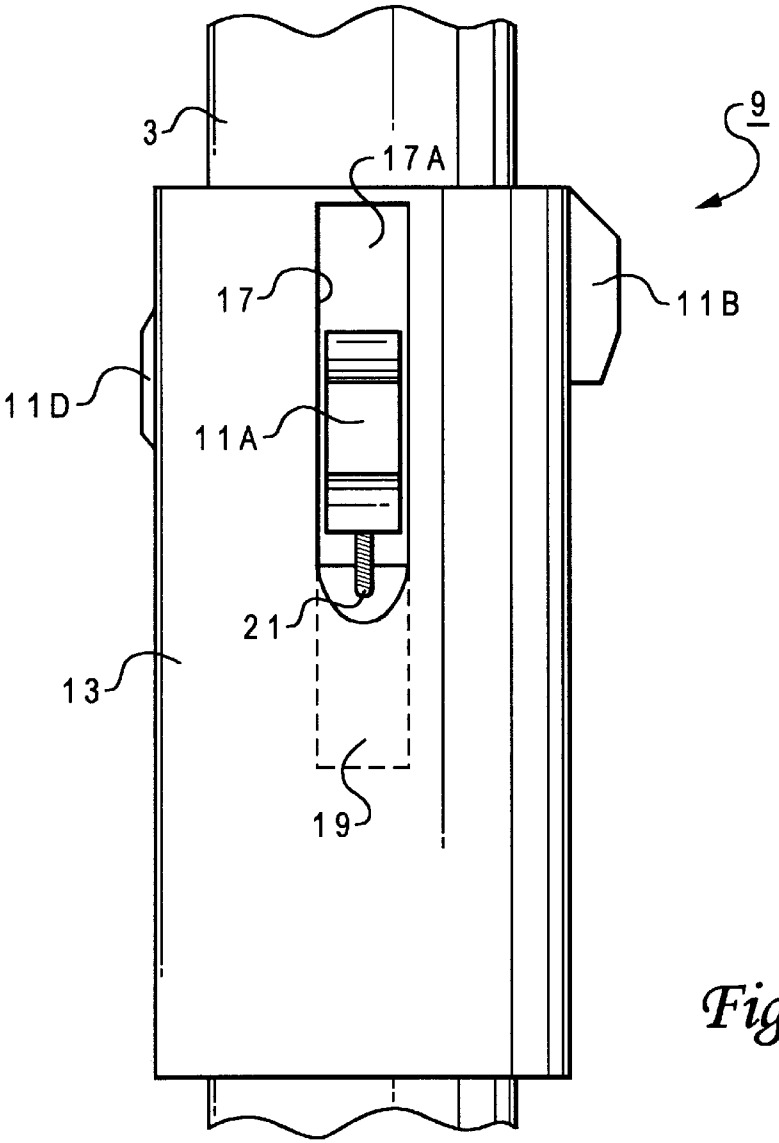
FIG. 2 is an elevation view of the stabilizer portion of the improved steering assembly of FIG. 1.
Figure 3:
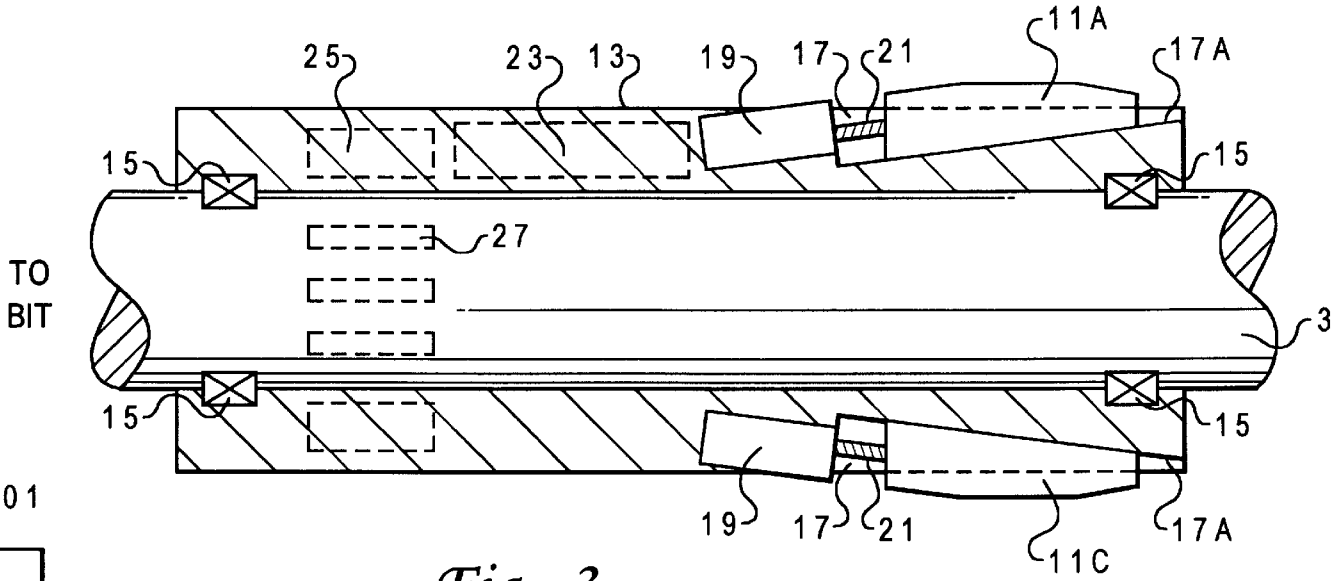
FIG. 3 is a longitudinal section view of the stabilizer portion of FIG. 2.

FIGS. 2 and 3 are elevation and longitudinal section views, respectively, of adjustable stabilizer 9 of the steering assembly according to the present invention. A generally cylindrical stabilizer body 13 is coupled to the exterior of generally cylindrical stabilizer sub 3 by bearings and seals 15, which permit stabilizer body 13 to rotate relative to stabilizer sub 3 and retain lubricant in the annular gap there between. According to the preferred embodiment of the present invention, at least four stabilizer blades 11A, 11B, 11C, 11D are received in longitudinal slots 17 in stabilizer body 13 and are retained therein by a tongue-and-groove arrangement. Each longitudinal slot 17 has an inclined bottom 17A, which defines a ramp wherein relative longitudinal movement between the stabilizer blades 11A–11D and ramp 17A causes radial expansion or retraction of stabilizer blades 11A–11D from stabilizer body 13. Associated with each slot 17 is a one-half horsepower electric motor 19. Motor 19 rotates a lead screw 21, which engages a ball nut (not shown) carried in each stabilizer blade 11A–11D to cause the relative longitudinal movement. Because each stabilizer blade 11A–11D is provided with its own actuator, in the form of motor 19 and lead screw 21, the stabilizer blades are independently extendable and retractable with respect to stabilizer body 13. Motors 19 preferably are stepper or servo motors adapted to control precisely the rotation of lead screws 21 and the extension of each stabilizer blade 11A–11D from stabilizer body 13.

A microprocessor or control unit 23 is coupled to each motor 19 and carried in stabilizer body 13 to control the rotation of motor 19 and lead screw 21, and thus the extension of stabilizer blades 11A–11D from stabilizer body 13. Microprocessor 23 contains conventional means for reading position data from encoders associated with each motor 19 to ascertain the extension of each stabilizer blade 11A–11D.

According to the preferred embodiment of the present invention, microprocessor or controller 23 and motors 19 are powered by a battery 25 carried in stabilizer body 13. Alternatively, if the drillstring (or a component thereof) is hardwired with a power supply, an inductive coupling between a plurality of coils 27 circumferentially spaced in stabilizer sub 3 and corresponding coils in body 13 can transmit electrical power from the drillstring to stabilizer body 13 in a reliable fashion.

According to the preferred embodiment of the present invention, the stabilizer blades are configured to collapse or retract to a reduced or minimum radial dimension relative to stabilizer sub 3 in the event that stabilizer 9 malfunctions or becomes stuck in the borehole. According to the preferred embodiment of the present invention, this is achieved by applying sufficient axial force, usually upward or uphole, to stabilizer 9 through drillstring 1. There are several ways by which stabilizer blades can be made to collapse upon application of sufficient axial force. In one embodiment, each lead screw 21 is designed to buckle in compression (from an uphole force) when stabilizer 9 is subjected to axial sticking loads of 10,000 pounds per stabilizer blade (or 40,000 pounds total). With the stabilizer blades thus detached from motors 19, blades 11A–11D are free to slide, aided by gravity and/or the removal of drillstring 3 from borehole 1, to a position on inclined surface 17A in slot 17 corresponding to a reduced or minimum radial extension.

Figure 4:
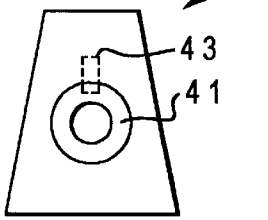
FIG. 4 is an enlarged end elevation view of a stabilizer blade according to the present invention.

FIG. 4 illustrates one embodiment of a stabilizer blade 11 that is designed to yield upon application of sufficient force. A ball nut or threaded nut 41 is secured within stabilizer blade 11 by one or more shear pins or screws 43, which are designed to yield upon application of sufficient axial force. Lead screws 21 are coupled to blades 11 through nuts 41 and application of force sufficient to yield shear pins or screws 43 detaches blades from nuts 41, lead screws 21, and motors 19, and allows them to collapse within slots 17. Similarly, the threads, of a separate nut or formed in the blades themselves, can be designed to yield upon application of sufficient axial force.

Figure 5:
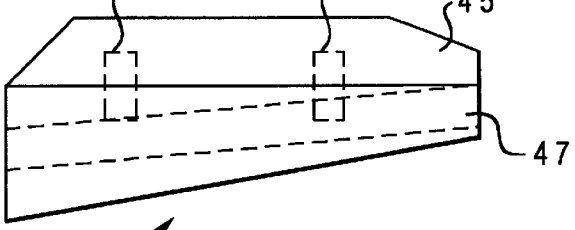
FIG. 5 is an enlarged elevation view of a stabilizer blade according to the present invention.

FIG. 5 illustrates another embodiment of blade 11 in which the blade comprises two sections or portions 45, 47, which are held together by shear pins or screws 49. Upon application of sufficient axial force, pins or screws 49 yield and portions 45, 49 separate. When outer portion 45 becomes separated from inner portion 47, the effect is a reduction in diameter of stabilizer 9 sufficient to permit withdrawal of drillstring 3 from borehole 1.

FIGS. 6A–6D are cross section views of borehole 1 and stabilizer body 13 and blades 11A–11D, taken along section line 6—6 of FIG. 1, depicting various configurations of stabilizer blades 11A–11D having varying effects on the trajectory of drill bit 5. For convenience, upper stabilizer blade is labeled 11A, right stabilizer blade is labeled 11B, bottom stabilizer blade is labeled 11C, and left stabilizer blade is labeled 11D.

Figure 6B:
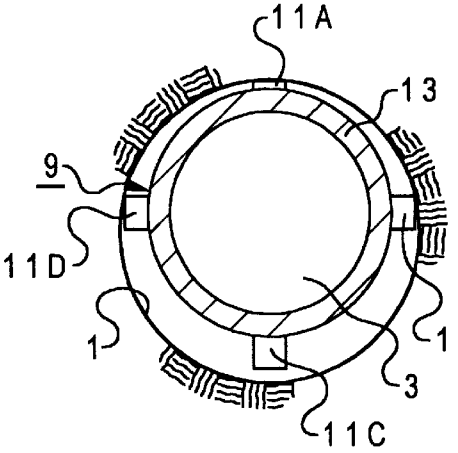
FIGS. 6A–6D are cross section view of the borehole and steering assembly, taken along section lines 6—6 of FIG. 1.
Figure 6D:
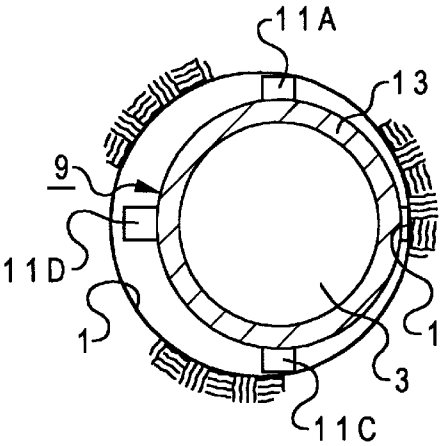
Figure 6A:
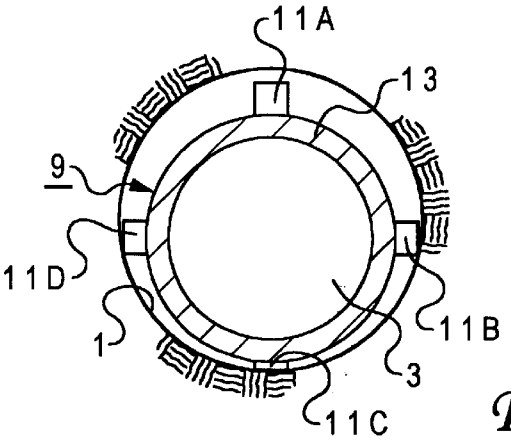

In FIG. 6A, stabilizer assembly 9 is configured to drop angle, or reduce the amount of deviation or deflection from vertical. In this configuration, upper stabilizer blade 11A is extended beyond stabilizer body 13 and into contact or engagement with the sidewall of borehole 1, while bottom stabilizer blade 11C is fully or near fully retracted. According to the preferred embodiment of the present invention, opposing stabilizer blades 11A, 11C are extendable to a diameter larger than the gage of the bit 5 or borehole 1. Of course, opposing stabilizer blades 11A, 11C are never simultaneously fully extended to avoid sticking in borehole 1. The same applies for opposing stabilizer blades 11B, 11D, which, in the drop angle configuration, are extended to an intermediate or retracted degree less than the gage of bit 5 and borehole 1.

In FIG. 6B stabilizer 9 is depicted in a configuration to build angle, or increase the amount of deviation or deflection from vertical in borehole 1. In this configuration, bottom stabilizer blade 11C is fully or near fully extended and upper stabilizer blade 11A is fully or near fully retracted. Again, right and left stabilizer blades 11B, 11D are extended to an intermediate or retracted degree less than the gage of bit 5 and borehole 1.

Figure 6C:
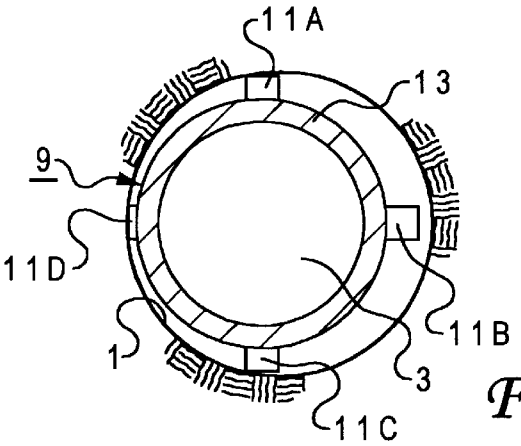

FIG. 6C illustrates stabilizer 9 in a configuration for turning bit 5 to the left in which right stabilizer 11B is extended and left stabilizer blade 11D is retracted, permitting changes in the azimuth of bit 5. Upper and lower stabilizer blades 11A, 11C are extended to an intermediate or retracted degree less than the gage of bit 5 and borehole 1 to hold angle.

Similarly, FIG. 6D depicts stabilizer 9 in a configuration to turn bit 5 left in which right stabilizer blade 11D is extended and right stabilizer blade 11B is near fully retracted, while upper and lower stabilizer blades 11A, 11C are extended to an intermediate or retracted degree to hold angle.

While FIGS. 6A–6D depict only four of the configurations of stabilizer 9 of the steering assembly according to the present invention, because each stabilizer blade 11A–11D is extendable independently of the others, a virtually infinite variety of stabilizer configurations and thus bit trajectories are possible. Of course, the virtually infinite adjustability of stabilizer 9 is made possible by coupling stabilizer body 13 for rotation to stabilizer sub 3, wherein it remains substantially stationary relative to borehole 1 as the drillstring rotates. This permits the differential or asymmetric extension of stabilizer blades 11A–11D, which, in turn, permits the wide range of trajectories achieved by the various configurations of stabilizer 9.

Of course, stabilizer body 13 cannot be expected to remain entirely stationary with respect to the sidewall of the borehole. Friction between the inner diameter of stabilizer body 13 and the outer diameter of stabilizer sub 3 is less than that between stabilizer blades 11A–11D and the sidewall of the borehole such that stabilizer body 13 makes approximately one revolution for each 100 to 500 feet drilled. As this slow rotation occurs, upper stabilizer 11A will tend to move toward the orientation of right stabilizer 11B and the same is true of stabilizer blades 11C and 11D. As the orientation of stabilizer blades 11A–11D changes with respect to the sidewall of borehole 1, corrections must be made to maintain the trajectory of bit 5 on the desired course.

A three-axis accelerometer having each accelerometer aligned on orthogonal axes is carried by stabilizer body 13 and coupled to microprocessor 23 to permit measurement of the inclination angle of stabilizer body 13 and the rotational orientation of stabilizer body 13 and blades 11A–11D. Microprocessor 23 is programmed to correct for changes in orientation of stabilizer sub 13 automatically, or can, through MWD apparatus, communicate this information to the surface for appropriate response. If MWD apparatus is employed, an AM radio transceiver (not shown) is carried by stabilizer body 13 to provide two-way radio communication between microprocessor 23 and the telemetry section of the MWD apparatus, which in turn may be in communication with the surface through one of several conventional telemetry or hardwire techniques.

Similarly, it is frequently advantageous to purposefully alter the configuration of stabilizer 9 to correct for unanticipated changes in bit trajectory due to unexpected changes in the formation material, the drilling characteristics of bit 5, and the like. Thus, the appropriate configuration for stabilizer 9 is determined at the surface is pre-programmed into microprocessor 23 or an MWD apparatus in the drillstring that is in communication with microprocessor 23. Motors 19, lead screws 21, and stabilizer blades 11A–11D then are adjusted appropriately for the desired trajectory or trajectory correction.

Figure 7:
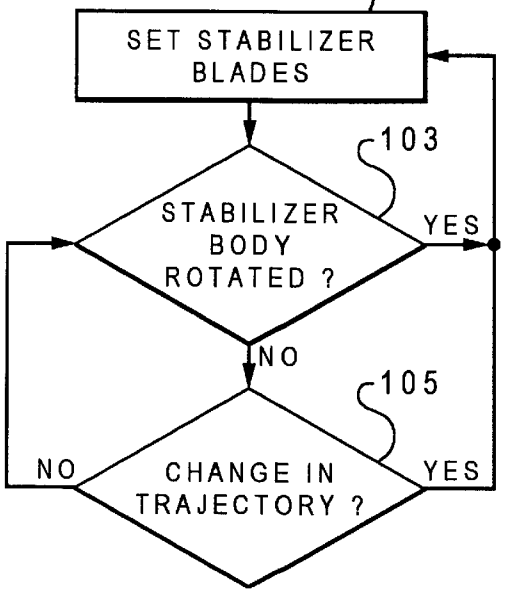
FIG. 7 is a flowchart depicting the operation and control of the adjustable stabilizer of the steering assembly of FIG. 1.

FIG. 7 is a flowchart depicting the control sequence and operation of the steering assembly according to the present invention. With reference to FIGS. 1–5, the operation of the steering assembly according to the present invention will be described. First, a bit is made up into a drillstring to drill an interval of vertical borehole to the kick-off or deflection point at which it is desired to commence directional drilling. If the kick-off point is sufficiently shallow so as not to deplete the life of the drill bit prior to or shortly after kick-off, the vertical drillstring can include stabilizer sub 3, along with fixed and adjustable stabilizers 7, 9. In the vertical section of the borehole, stabilizer blades 11A–11D are fully retracted or positioned at an extension less than the gage of bit 5 and borehole 1, wherein stabilizers 7, 9 simply function as centralizers.

At the kick-off point, stabilizer 9 and stabilizer blades 11A–11D are set in the configuration adapted for the kick-off trajectory, as reflected at step 101 of FIG. 5. The controlled misalignment caused by spaced-apart stabilizers 7, 9 causes deflection of stabilizer sub 3 and bit 5 from the vertical axis of borehole 1, and directional drilling is commenced.

As reflected at step 103 of FIG. 5, stabilizer body 13 is monitored by microprocessor 23 alone or together with MWD apparatus, which may be in communication with the surface, for rotation relative to borehole 1. If rotation of stabilizer body 13 is detected, this information is communicated to or through microprocessor 23, which takes corrective action to readjust the configuration of stabilizer blades 11A–11D to compensate for rotation of stabilizer body 13 in borehole 1.

If no rotation of stabilizer body 13 is detected, at step 105 in FIG. 5, it is determined whether a change of trajectory is desired. Such a change in trajectory is programmed in microprocessor 23 and triggered by measurements from the accelerometers carried by stabilizer body 13, or by survey data from an MWD apparatus that indicates a change in trajectory is appropriate, or may be communicated to microprocessor 23 via telemetry from the surface when there is a surface-detected or monitored indication that a change in trajectory is warranted.

As reflected by the flowchart of FIG. 5, if neither rotation of stabilizer body 13 is detected nor is a trajectory charge or correction warranted, microprocessor 23 continues to monitor both conditions for appropriate response in the event of the occurrence of either condition.

The present invention provides a number of advantages over prior-art steering assemblies and systems. A principal advantage is that the steering system is adapted for use with efficient surface-rotation drilling techniques and their associated high rates of penetration. The steering assembly according to the present invention does not require complex hydraulic and mechanical systems to effect deflection of the bit or changes in its trajectory during drilling operation.

The invention has been described with reference to a preferred embodiment thereof. It is thus not limited, but is susceptible to variation and modification without departure from the scope and spirit of the invention.

I claim:

1. An improved assembly for steering a rotating drillstring in a borehole, the assembly comprising:

a stabilizer sub for attachment into a drillstring;

a stabilizer body rotatably carried by the stabilizer sub, wherein the stabilizer body remains substantially stationary relative to the borehole as the drillstring rotates;

at least one stabilizer blade carried by the stabilizer body, the stabilizer blade being radially extendable from the stabilizer body and into engagement with the sidewall of the borehole, the stabilizer blade carried by the stabilizer such that, in the event the stabilizer body becomes stuck in the borehole, the stabilizer blades can be collapsed by applying a selected force to the drillstring from the surface.

2. The assembly according to claim 1 further comprising:

at least three stabilizer blades spaced apart on the circumference of the stabilizer body.

3. The assembly according to claim 1 wherein each stabilizer blade is carried in a longitudinal slot in the stabilizer body, the slot having an inclined bottom and relative longitudinal movement between the stabilizer blade and stabilizer body causes extension or retraction of the stabilizer blade.

4. The assembly according to claim 3 further comprising:

a motor coupled between each stabilizer blade and the stabilizer body to cause relative longitudinal movement there between.

5. The assembly according to claim 1 wherein the stabilizer sub includes a fixed stabilizer at an end opposite the drill bit.

6. The assembly according to claim 4 wherein a portion of coupling between the stabilizer body and the stabilizer blade yields responsive to application of the selected force to the drillstring, permitting the stabilizer blade to collapse to reduced radial extension in the slot.

7. An improved assembly for steering a rotating drillstring in a borehole, the assembly comprising:

a stabilizer sub for attachment into the drillstring adjacent a drill bit;

a stabilizer body rotatably carried by the stabilizer sub, wherein the stabilizer body remains substantially stationary relative to the borehole as the drillstring rotates;

at least a pair of generally opposed stabilizer blades carried by the stabilizer body, the stabilizer blades being independently radially extendable from the stabilizer body and into engagement with the sidewall of the borehole; and means coupling the stabilizer blade to the body wherein, upon the drillstring becoming stuck in the borehole, application of a selected force to the drillstring causes the blades to retract to a reduced radial extension relative to the stabilizer body.

8. The assembly according to claim 7 further comprising:

four stabilizer blades spaced apart on the circumference of the stabilizer body.

9. The assembly according to claim 7 wherein each stabilizer blade is carried in a longitudinal slot in the stabilizer body, the slot having an inclined bottom and relative longitudinal movement between the stabilizer blade and stabilizer body causes extension or retraction of the stabilizer blade.

10. The assembly according to claim 9 wherein the coupling means further comprises:

a motor carried by the stabilizer body and turning a lead screw coupled to each stabilizer blade to cause relative longitudinal movement between the stabilizer blade and the slot.

11. The assembly according to claim 7 wherein the stabilizer sub includes a fixed stabilizer at an end opposite the drill bit.

12. The assembly according to claim 10 wherein a portion of the means coupling between the stabilizer body and the stabilizer blade yields responsive to application of the selected force to the drillstring, permitting the stabilizer blade to collapse to reduced radial extension in the slot.

13. An improved assembly for steering a rotating drillstring in a borehole, the assembly comprising:

a stabilizer sub for attachment into the drillstring adjacent a drill bit;

a stabilizer body rotatably carried by the stabilizer sub, wherein the stabilizer body remains substantially stationary relative to the borehole as the drillstring rotates, at least one longitudinal slot formed in the exterior of the stabilizer, the slot having an inclined bottom;

at one stabilizer blade carried in the slot in the stabilizer body, the stabilizer blade being independently radially extendable from the stabilizer body and into engagement with the sidewall of the borehole by longitudinal movement in the slot having the inclined bottom, wherein each stabilizer blade is coupled to the stabilizer body such that, in the event the stabilizer body becomes stuck in the borehole, the stabilizer blades can be retracted by applying a selected force to the drillstring from the surface;

a motor carried by the stabilizer body and coupled to the stabilizer blade to cause longitudinal movement of the stabilizer blade in the slot; and a source of electrical power carried by the stabilizer sub and in electrical communication with the motor.

14. The assembly according to claim 13 further comprising:

four stabilizer blades spaced apart in four longitudinal slots in the circumference of the stabilizer body; and four motors carried by the stabilizer body.

15. The assembly according to claim 13 wherein a lead screw couples the motor to the stabilizer blade, rotation of the lead screw by the motor causing longitudinal movement of the stabilizer blade in the slot.

16. The assembly according to claim 15 in which the lead screw yields upon application of the selected force and permits the stabilizer blades to retract within the slots.

17. The assembly according to claim 15 in which a coupling between the lead screw and the stabilizer blade yields upon application of the selected force and permits the stabilizer blades to retract within the slots.

18. The assembly according to claim 17 in which the coupling includes a shear member.

19. The assembly according to claim 13 wherein the stabilizer sub includes a fixed stabilizer at an end opposite the drill bit.

20. A method of steering a drillstring in a borehole, the method comprising the steps of:

making a stabilizer sub into a drillstring above a drill bit, the stabilizer sub including:

a stabilizer body rotatably carried by the stabilizer sub, wherein the stabilizer body remains substantially stationary relative to the borehole as the drillstring rotates;

at least a pair of stabilizer blades carried by the stabilizer body, the stabilizer blades being independently radially extendable from the stabilizer body and into engagement with the sidewall of the borehole;

running the drill string into the borehole;

rotating the drillstring;

selectively and independently extending and retracting each of the stabilizer blades into and out of engagement with the sidewall of the borehole to alter the direction of drilling of the drill bit; and in the event that the stabilizer or drillstring becomes stuck in the borehole, collapsing the stabilizer blades to reduced radial extension from the body by applying a selected force to the drillstring.

21. The method according to claim 20 further wherein the step of independently extending and retracting the stabilizer blades is controlled from the surface via telemetry.

22. The method according to claim 20 further wherein the step of independently extending and retracting the stabilizer blades is controlled by measurement-while-drilling apparatus carried in the drillstring.

* * * * *